United States Patent [19]

Williams

[11] Patent Number: 4,670,932

[45] Date of Patent: Jun. 9, 1987

[54] CLEANER TOOL FOR CLEATED SHOES

[76] Inventor: Jeffrey S. Williams, 19 Lundys La., Richardson, Tex. 75080

[21] Appl. No.: 817,822

[22] Filed: Jan. 10, 1986

[51] Int. Cl.[4] ..... A47L 23/00

[52] U.S. Cl. ..... 15/237; 15/236 R; 254/25; 273/32 B

[58] Field of Search ..... 15/104 R, 236 R, 237, 15/105; 254/18, 25; 36/1, 134; 273/32 B; 7/118, 158

[56] References Cited

U.S. PATENT DOCUMENTS

| | | | |
|---|---|---|---|
| 2,352,010 | 6/1944 | Robbins | 15/236 R X |
| 2,980,936 | 4/1961 | Snow et al. | 15/237 X |
| 3,050,760 | 8/1962 | Darnell | 15/237 X |
| 3,111,698 | 11/1963 | Reichle | 15/237 X |
| 3,310,826 | 3/1967 | Ellis | 15/236 X |
| 3,364,508 | 1/1968 | Garrett | 15/105 X |
| 3,496,590 | 2/1970 | Yates | 15/105 |
| 3,987,827 | 10/1976 | Mills | 254/25 X |
| 4,112,537 | 9/1978 | Heuck | 15/236 R |

*Primary Examiner*—Edward L. Roberts

*Attorney, Agent, or Firm*—Hubbard, Thurman, Turner & Tucker

[57] ABSTRACT

A portable tool of durable thermoplastic composition for cleaning or removing mud or other debris from the heels and soles of a cleated shoe. A swordlike handle is secured to an elongated blade which extends to a beveled scraping edge at its distal end. The blade end is of a width dimension adapted to pass between adjacent cleats and is centrally grooved or slotted for intervening receipt of a cleat during cleaning. A transverse guard plate extending about the blade at the inboard end of the handle protects a user's hand on the handle against dirt and/or cleat contact during the course of debris removal.

13 Claims, 7 Drawing Figures

CLEANER TOOL FOR CLEATED SHOES

TECHNICAL FIELD

The technical field to which the art pertains comprises the art of scraping utensils for removing unwanted deposits from a surface by scraping.

BACKGROUND OF THE INVENTION

Athletic shoes for various of the more popular outdoor sports are usually constructed with cleats outwardly extending from the underside of the heel and sole to aid in turf traction by the wearer. While highly advantageous and preferred by participants of sports such as golf, use of the cleated shoes in walking through soft or muddy soils can result in unwanted adherence of ground clumps in and about the cleats. Such adherence is annoying to the wearer of the shoes by virtue of the added weight and discomfort incurred when walking. At the same time, the clumps can so effectively bury the cleat members as to at least partially if not completely eliminate the traction benefit thereof. When the latter occurs the purpose for which the cleats were provided is essentially defeated. As a consequence, many athletes such as golfers who depend on the traction afforded by the cleats frequently prefer to remove almost immediately any mud patches adhering to the underside of their cleated shoes.

Cleaning such cleated shoes on or off the wearer's foot of wet or caked on mud or dried dirt usually involves use of a utensil of sorts such as a pocket knife, screw driver blade, or other available implement suitable to effect scraping. These prior art approaches for cleaning can ultimately be effective but are generally unsatisfactory from the standpoint of getting mud or dirt on a user's hands and/or potentially abrading the user's knuckles or fingers from a slipping encounter with the relatively pointed end of the cleat members. This problem can become most acute where the mud has been permitted to dry and becomes increasingly difficult to remove. Most athletes, particularly golfers when on the golf course during a round of golf strongly prefer to maintain their hands clean and unabraded as could likely soil or otherwise adversely affect their subsequent handling of the golf clubs.

Despite recognition of the problem, a suitable utensil therefor has not previously been available.

SUMMARY OF THE INVENTION

The invention relates to a tool or utensil for removing mud or debris from the heel and sole of cleated shoes of the type used in athletics. More specifically, the invention relates to such a utensil that is light weight and portable yet is effective for removing mud and debris about the cleat in a manner which affords the safety of protecting the user's hand against being soiled by the debris or abraded by inadvertent contact with a cleat.

The foregoing is achieved in accordance with the invention by means of a light weight portable tool formed substantially as a unitary structure and comprised of a swordlike handle secured to an elongated blade that terminates at its distal end in a centrally grooved beveled scraping edge. The blade is generally of rectangular cross section and of a width sized to be passed through the spacing normally provided between adjacent cleats. At an intermediate location on the blade substantially at the inboard end of the handle there is provided a transverse guard surrounding the blade which separates the user's hand from the cleaning end of the tool thereby protecting the hand against dirt or cleat contact.

It is therefore an object of the invention to provide a novel tool for removing dirt or debris from the heel and sole of cleated shoes.

It is a further object of the invention to effect the previous object with a tool that is portable and of relatively low cost so as to render the tool convenient to carry and readily affordable by those athletes wishing to have such tools.

Figure 1:
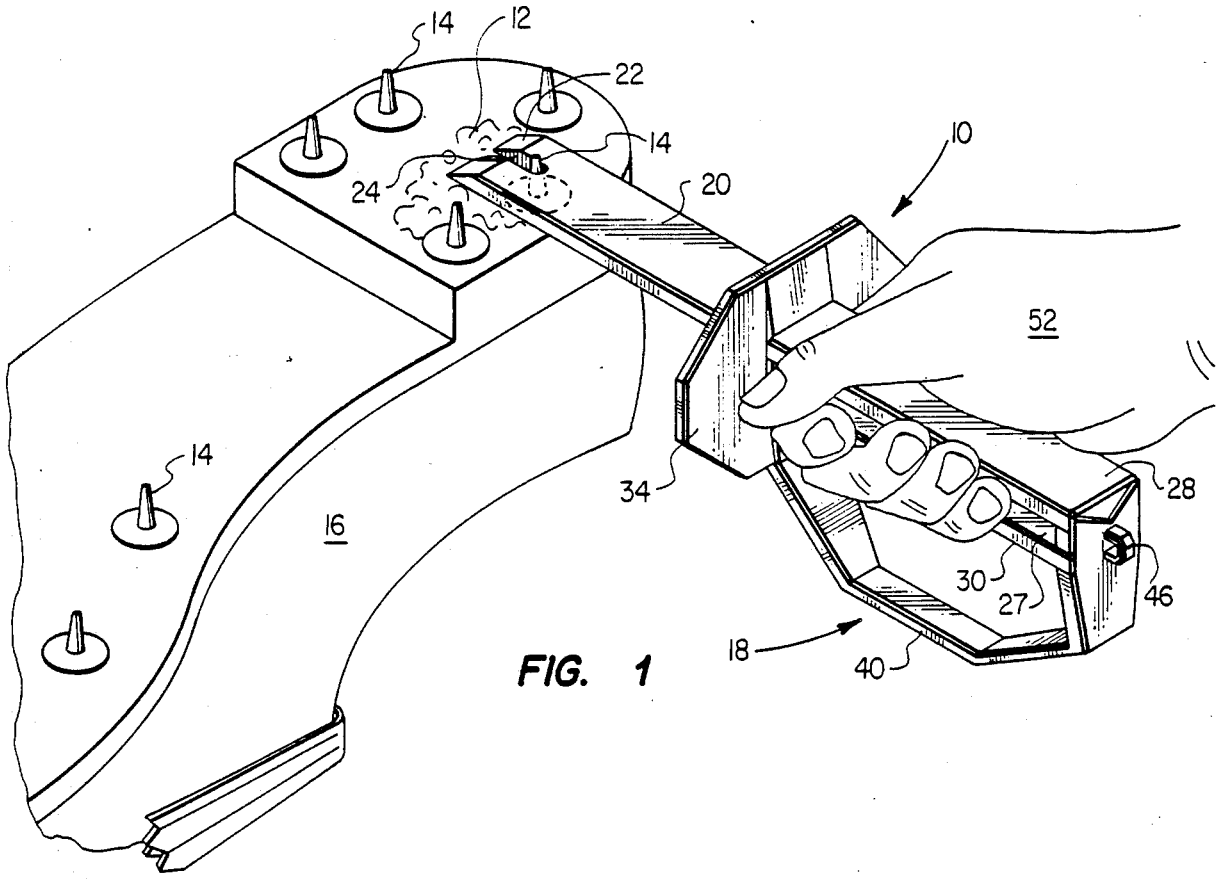
FIG. 1 is an isometric illustration of the tool of the invention in the course of being utilized.
Figure 4:
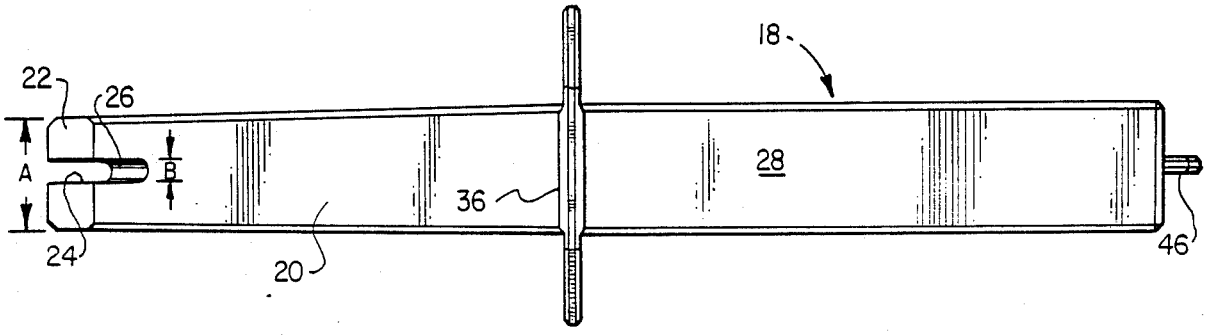
FIG. 4 is a top plan view of FIG. 3.
Figure 5:
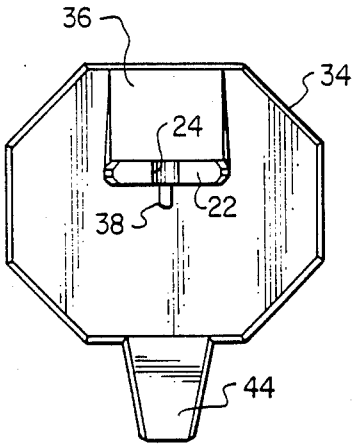
FIG. 5 is a front end view of FIG. 3.
Figure 6:
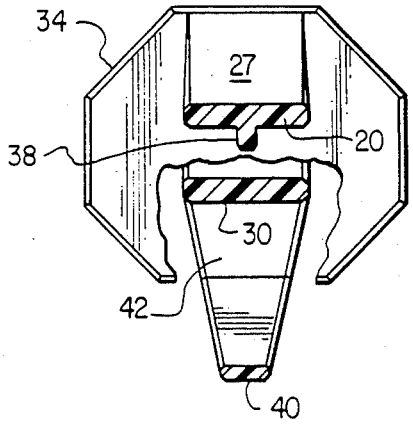
FIG. 6 is a sectional view as seen substantially from the position 6—6 of FIG. 3.

Referring now to the drawings, the cleat cleaning tool hereof is designated 10 and is adapted as shown in FIG. 1 for the removal of mud 12 from and about cleats 14 on the underside of golf shoe 16. Comprising the tool is a swordlike handle 18 secured to an elongated blade 20 of substantially rectangular cross-section extending to a beveled or chisel shaped scraping edge 22 at its distal end. Contained in the distal end of blade 20 is an inwardly extending longitudinal groove or slot 24 likewise formed at its inboard end with a beveled or chisel shaped scraping face 26. For these purposes as will be appreciated, width A of blade 20 (see FIG. 4) at least in the vicinity of end 22 is less than the spacing between adjacent cleats 14 whereas the opening width B of longitudinal groove 24 is greater than the largest surface diameter of the cleats 14. For at least golf shoe applications width A can typically be on the order of about $\frac{7}{8}$ inches while width B can typically be on the order of about 3/16 inches.

Figure 2:
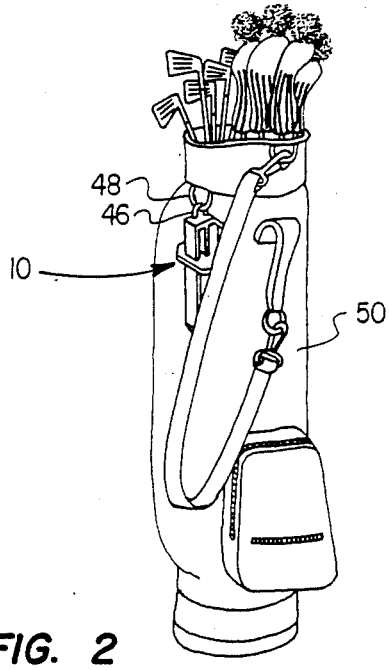
FIG. 2 is an elevation view of a golf bag illustrating the tool of the invention being carried suspended thereon.
Figure 7:
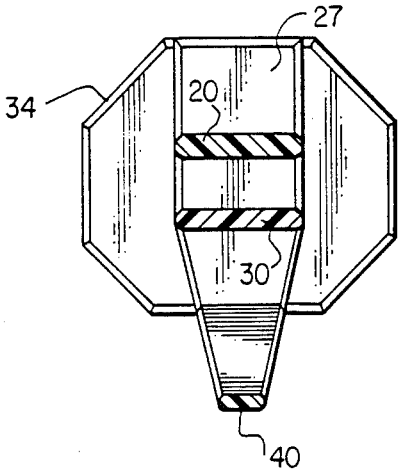
FIG. 7 is a sectional view as seen substantially from the position 7—7 of FIG. 3.
Figure 3:
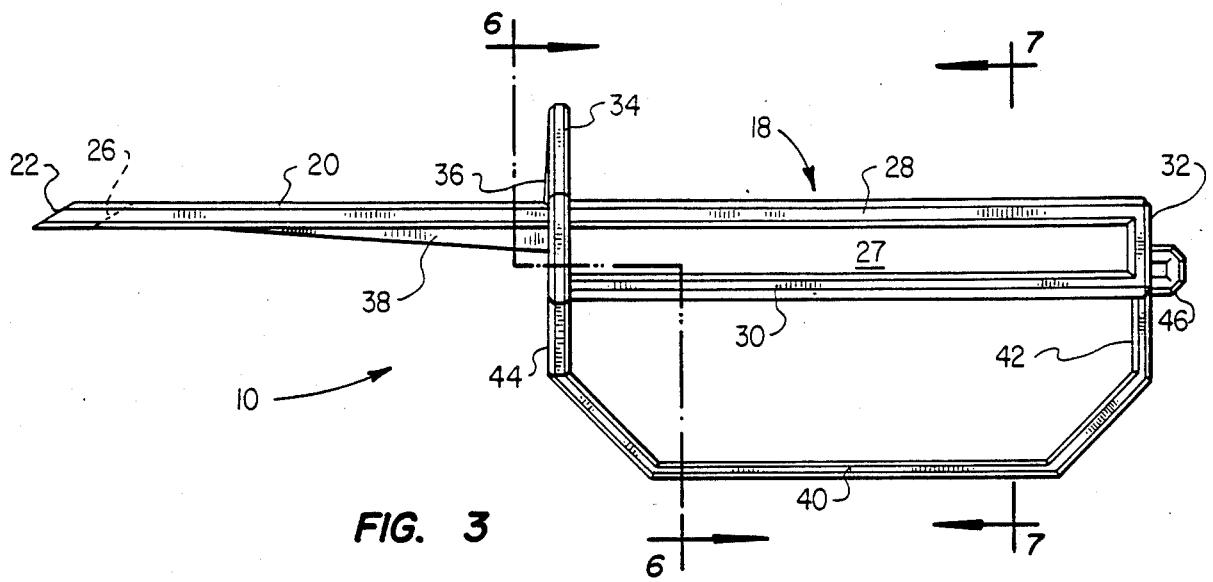
FIG. 3 is a side elevation of the tool of the invention.

Handle 18 includes a generally open gripper section 27 formed of the inboard portion 28 of blade 20 and a parallel spaced apart bar 30 joined at their rear or butt end by a vertical end bar 32. Closing gripper section 27 at an intermediate location along blade 20 is transversely arranged octagonally shaped guard 34 extending about blade 20. The guard is secured by a thickened width dimension 36 at the top side of blade 20 and is reinforced longitudinally for rigidity via an elongated rib 38 extending along at the underside of blade 20. Completing the underside of handle 18 while rendering it sword-like is a looping guard 40 which at its rear 42 effects a coplanar joinder with the under edge of bar 30 and at its forward end 44 is offset to effect a coplanar joinder with the under edge of guard 34. A lanyard loop 46 on the butt end of handle 18 enables insertion of a ring 48 for mounting via a clip (not shown) for example onto a golf bag 50 (FIG. 2).

The entire unit including blade 20, handle 18 and guard 34 are formed of a light weight composition as to render the tool readily portable. At the same time the selected composition is characterized by having a relatively high tensile strength and high flexural modulus throughout the useful temperature range in which this tool is likely to be used. It will be appreciated that considerable force and/or bending moment may be encountered when attempting to chisel or scrape off dried dirt. Found suitable in a preferred embodiment for these purposes are commercially available grades of acrylic thermoplastics enabling the unit to be formed as a unitary structure (except for loop 46) by injection molding that affords high volume production of manufacture at a low cost per unit. Preferably, all edges and corners as shown double lined are chamfered or rounded so as to avoid any sharp corners. Also, all surfaces are smoothed and polished for rendering the tool safe and attractive to the consumer likely to purchase such a tool. The selected plastic composition may suitably be either transparent or opaque of any desired color.

By the above description there is disclosed a novel tool for cleaning mud or debris from the underside of cleated shoes as illustrated in FIG. 1. The user can readily place a hand 52 about handle grip 27 for utilizing the tool which via its scraping edge 24 will scrape mud or other debris 12 away from the vicinity of cleats 14. With longitudinal groove 24 positioned about a cleat 14 any mud or debris immediately contiguous to the cleat can be removed by maneuvering the tool in various directions while scraping about the cleat member. Since handle 18 is sufficiently removed from the cutting edge 22 of the blade and is separated therefrom by guard 34, hand 52 is protected in the course of cleaning from being soiled by removed dirt 12 which typically can comprise either soft or hard caked mud presently or previously acquired. Further protection is afforded to hand 52 by transverse guard 34 which shields the hand in the event of inadvertent slippage of the tool past or over a cleat member whereby an encounter between an upstanding cleat and hand could otherwise occur. At the same time, the entire unit is very light weight as to render it conveniently portable and via languard loop 46 can be conveniently carried or stored as preferred. The foregoing therefore fulfills a long felt need for athletes that are commonly troubled with problems associated with muddy cleats as can detract from their skills in participation of the sport. At the same time cleaning of the cleats is achieved without adversely exposing the hand during the course of shoe cleaning.

Since many changes could be made in the above construction and many apparently widely different embodiments of this invention could be made without departing from the scope thereof, it is intended that all matter contained in the drawings and specification shall be interpreted as illustrative and not in a limiting sense.

I claim:

1. A tool for the cleaning removal of debris from the cleated under surface of a cleated shoe comprising:

(a) an elongated blade extending to a scraping edge formation at its distal end;

(b) a groove defined extending inward from said distal end, said groove being of a width and length dimension generally greater than the cross sectional width dimension of individual cleats on a shoe to be cleaned;

(c) a hand-grip handle secured to said blade at a location displaced from said distal end; and (d) a transverse guard secured about said blade at a location intermediate said handle and said distal end of said blade for providing protection to a user's hand positioned about said grip handle.

2. A tool according to claim 1 in which the inwardmost face of said groove includes a second scraping edge formation separate and displaced from the scraping edge at said distal end.

3. A tool according to claim 2 in which said blade is generally of rectangular cross section and at least in the vicinity of said distal end is of a width dimension less than the spacing dimension between adjacent cleats on a shoe to be cleaned.

4. A tool according to claim 2 including an elongated rib longitudinally extending along the underside of said blade to a connection with a face of said guard.

5. A tool according to claim 4 in which substantially all corners and edges of said blade, handle and guards are smoothly chamfered or rounded.

6. A tool according to claim 2 in which said handle is defined by parallel spaced apart bar members joined by a transverse bar defining the butt end of said handle.

7. A tool according to claim 2 including a second guard extending looped about the underside of said handle at a spacing below said handle permitting hand entry for gripped placement on said grip handle and rendering the handle and guard in combination swordlike in appearance.

8. A tool according to claim 7 in which said blade, said handle and said guards are comprised of a unitary structure integrally joined.

9. A tool according to claim 8 in which said blade, said guards and said handle are at least substantially comprised of a polymer plastic composition.

10. A tool according to claim 9 in which said blade, said handle and said guards are injection molded as a singular unit.

11. A tool according to claim 8 including a loop secured to the butt end of said handle and adapted for mounting of the tool onto a support.

12. A tool according to claim 2 in which said scraping edge formation at said distal end is substantially planar and the side surfaces defining said groove extend substantially normal to the plane of said distal end formation.

13. A tool for the cleaning removal of debris from the cleated under surface of a cleated shoe comprising:

(a) an elongated blade extending to a scraping edge formation at its distal end;

(b) a groove defined extending inward from said distal end, said groove being of a width and length dimension generally greater than the cross sectional width dimension of individual cleats on a shoe to be cleaned and including an inwardmost face having a scraping edge formation;

(c) said scraping edges of both said blade and said groove face being beveled or chisel shaped;

(d) a hand-grip handle secured to said blade at a location displaced from said distal end; and (e) a transverse guard secured about said blade at a location intermediate said handle and said distal end of said blade for providing protection to a user's hand positioned about said grip handle.

* * * * *